US005425342A

United States Patent [19]

Ariga et al.

[11] Patent Number: 5,425,342

[45] Date of Patent: Jun. 20, 1995

[54] FUEL INJECTION APPARATUS

[75] Inventors: Hironobu Ariga; Kazuhiro Sato, both of Kanagawa, Japan

[73] Assignee: Nissan Motor Co., Ltd., Yokohama, Japan

[21] Appl. No.: 214,168

[22] Filed: Mar. 16, 1994

[30] Foreign Application Priority Data

Mar. 16, 1993 [JP] Japan ..... 5-054452

[51] Int. Cl.[6] ..... F02M 27/04

[52] U.S. Cl. ..... 123/456; 123/514; 123/179.17

[58] Field of Search ..... 123/456, 457, 463, 179.17, 123/514, 506

[56] References Cited

U.S. PATENT DOCUMENTS

| | | | |
|---|---|---|---|
| 3,614,945 | 10/1971 | Shlagmüller | 123/179.17 |
| 3,614,946 | 10/1971 | Staudt | 123/179.17 |
| 4,156,560 | 5/1979 | Chekwich | 123/456 |
| 4,274,380 | 6/1981 | de Vulpilliers | 123/514 |
| 4,300,509 | 11/1981 | Schfchter | 123/456 |
| 4,562,816 | 1/1986 | Dorr | 123/456 |
| 4,800,859 | 1/1989 | Sagisaka | 123/463 |
| 4,829,964 | 5/1989 | Asayama | 123/463 |
| 4,984,554 | 1/1991 | Ariga | 123/179.17 |
| 5,207,203 | 5/1993 | Wagner | 123/514 |

FOREIGN PATENT DOCUMENTS 63-120848 5/1988 Japan .

*Primary Examiner*—Carl S. Miller

*Attorney, Agent, or Firm*—Lowe, Price, LeBlanc & Becker

[57] ABSTRACT

An apparatus for injecting fuel into an engine through fuel injectors connected to a fuel tank through a fuel supply passage having a fuel pump provided therein. The apparatus include a first pressure regulator provided in the fuel supply passage between the fuel pump and the fuel injectors for varying the amount of excess fuel returned through a first return passage to the fuel tank to maintain a first predetermined pressure differential across the fuel injectors. The apparatus also includes a second pressure regulator provided in the fuel supply passage downstream of the fuel injectors for varying the amount of excess fuel returned through a second return passage to the fuel tank to maintain a second predetermined pressure differential across the fuel injectors. The second predetermined pressure differential is higher than the first predetermined pressure differential. A control valve is provided in the first return passage. The control valve is normally open and it closes the first return passage to inhibit the pressure regulation of the first pressure regulator under predetermined engine starting conditions.

9 Claims, 4 Drawing Sheets

FUEL INJECTION APPARATUS

BACKGROUND OF THE INVENTION

This invention relates to an apparatus for injecting pressure regulated fuel through fuel injectors into an internal combustion engine.

Fuel injection apparatus have been used to inject pressure regulated fuel into an internal combustion engine through fuel injectors provided in a fuel supply passage extending from a fuel tank. In order to provide a linear relationship between the amount of fuel injected into the engine and the length of time the fuel injector opens, it is required to maintain the pressure differential across the fuel injectors at a predetermined level. For example, Japanese Patent Kokai NO. 63-120848 discloses such a fuel injection apparatus which achieves this pressure regulation with the use of a pressure regulator provided in the fuel supply passage for varying the amount of excess fuel returned through a return passage to the fuel tank. While the fuel passes the return passage, it is heated to increase the temperature of the fuel stored in the fuel tank. Since the fuel pump is designed to have a sufficient capacity, a great amount of excess fuel will be returned through the return passage so as to produce a great fuel temperature increase which may be a cause of vapor lock.

SUMMARY OF THE INVENTION

It is a main object of the invention to provide an improved fuel injection apparatus which is free from an excessive fuel temperature increase which may be a cause of vapor lock.

There is provided, in accordance with the invention, a fuel injection apparatus for an internal combustion engine. The fuel injection apparatus comprises a fuel injector connected to a fuel tank through a fuel supply passage for injecting fuel into the engine, a fuel pump provided in the fuel supply passage for pressurizing the fuel supplied from the fuel tank to the fuel injector, and a first pressure regulator provided in the fuel supply passage. The first pressure regulator is operable for varying the amount of excess fuel returned through a first return passage to the fuel tank to maintain a first predetermined pressure differential across the fuel injector. A control valve is provided in the first return passage for closing the first return passage in response to a command signal. The fuel injection apparatus also comprises a second pressure regulator provided in the fuel supply passage downstream of the first pressure regulator. The second pressure regulator is operable for varying the amount of excess fuel returned through a second return passage to the fuel tank to maintain a second predetermined pressure differential across the fuel injector. The second predetermined pressure differential is higher than the first predetermined pressure differential. A control unit is provided which is rmined engine conditions for producing the command signal to the control valve.

According to another aspect of the invention, there is provided a fuel injection apparatus comprising a fuel tank containing fuel, a plurality of fuel injectors for an engine, a fuel gallery fluidly connected to the the plurality of fuel injectors, a fuel pump supplying the fuel to the fuel gallery, and means for regulating return of the fuel from the fuel gallery to the fuel tank. The fuel injection apparatus is characterized in that the regulating means includes a first regulator mounted adjacent the fuel tank and having a first return passage communicating with the fuel tank, a second regulator mounted adjacent the fuel gallery and having a second return passage communicating with the fuel tank, and means for normally rendering said first regulator operable to permit all of the return flow of fuel to pass through said first return passage to the fuel tank, but rendering said first regulator inoperable under a predetermined condition upon starting the engine, causing said second regulator to become operable to permit all of the return flow of fuel to pass through said second return passage to the fuel tank.

DETAILED DESCRIPTION OF THE INVENTION

Figure 1:
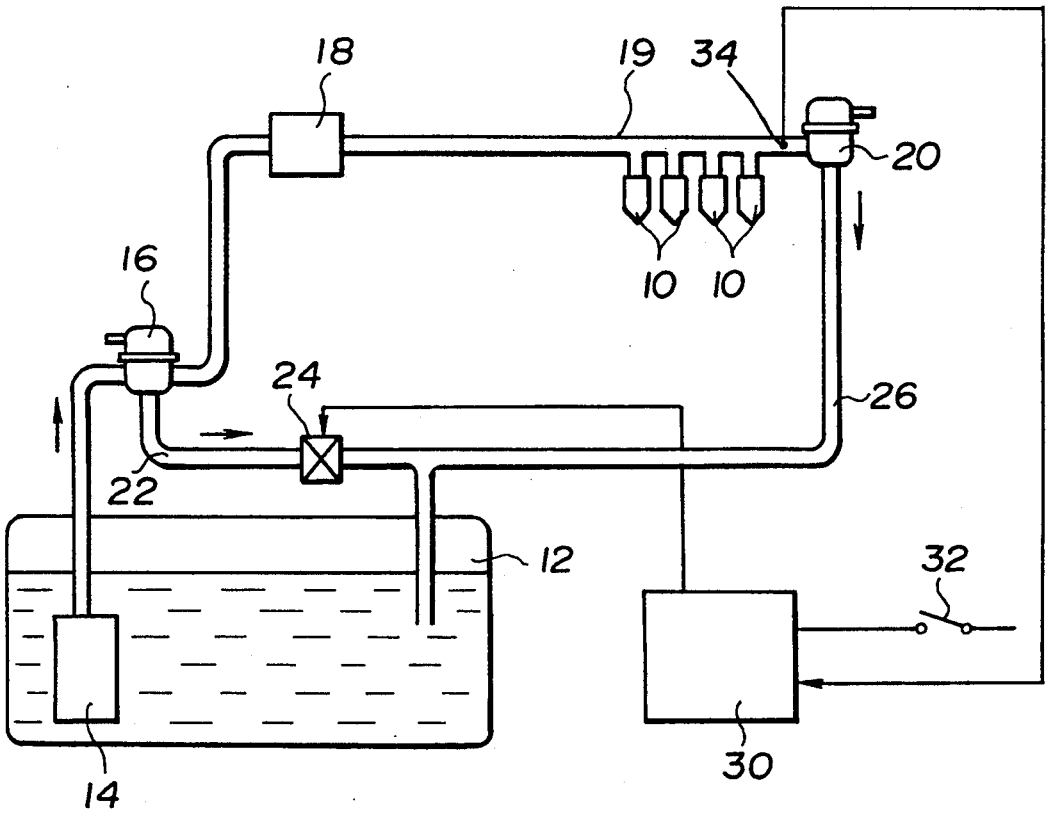
FIG. 1 is a schematic diagram showing one embodiment of a fuel injection apparatus according to the invention.

With reference to the drawings, and in particular to FIG. 1, a fuel injection apparatus is shown as applied to an internal combustion engine having four cylinders and an ignition switch 32. The engine has an intake manifold connected to intake ports of the cylinders of the engine. The engine is mounted within an engine compartment of an automotive vehicle in front of a passenger's compartment. The vehicle has a fuel tank 12 at a portion sufficiently spaced from the engine in order to minimize heat transmission from the engine to fuel contained in the fuel tank 12. The fuel tank 12 is mounted adjacent a luggage compartment behind the passenger compartment. Irrespective of the layout, there is a heat transmission from the engine to the fuel contained in the fuel tank 12. This heat transmission is caused by fuel returning to the fuel tank after passing through a fuel passage or conduit extending through an area adjacent the cylinder head where fuel injectors 10 are mounted. Four fuel injectors 10 are shown since the fuel injection apparatus is applied to the four-cylinder internal combustion engine of the port injection type. The fuel injectors 10 are mounted for injecting fuel into the intake manifold toward the intake ports of the respective cylinders. For fuel injection, a pressure differential, i.e., a difference in pressure between a pressure in the intake manifold adjacent the injection point and a pressure of fuel supplied to the fuel injectors 10, has to be maintained at an appropriate level. This appropriate level may be variable, and if there occurs a change in this level, a correction of the pulse-width of fuel injection pulse is needed.

The fuel injectors 10 are connected to a fuel gallery 19 which forms a part of a fuel supply passage of a fuel supply system. A temperature sensor 34 is disposed in the fuel gallery 19 to detect the fuel temperature and generates a temperature signal indicative of the detected temperature. This signal is fed to a control unit 30. The fuel supply system includes the fuel tank 12, a fuel pump 14 placed in the fuel tank 12, a first pressure regulator 16, a fuel filter 18, and a second pressure regulator 20. The fuel pump 14 is electrically operated and is operable to draw in and discharge fuel under pressure. The first pressure regulator 16 is disposed adjacent the fuel tank 12 and communicates with the fuel pump to receive fuel discharged by the pump 14. The first pressure regulator 16 is operable to effect pressure regulation to maintain the pressure differential across the fuel injectors 10 at a first predetermined level P1, for example, about 2.55 kg/cm$^2$. During this pressure regulation, a portion of the fuel is returned to the fuel tank 12 through a first return passage 22 which is disposed adjacent the fuel tank 12. Since the first pressure regulator 16 and the first return passage 22 are disposed within an area sifficiently remote from the engine to minimize hear transmission from the engine, the return flow of fuel contributes least to elevation of temperature of the fuel contained in the fuel tank 12. In other words, the first return passage 22 is placed at a portion remote from the engine cylinder head and other engine parts which are elavated to high temperatures during operation of the engine.

A solenoid operated control valve 24 is provided in the first return passage 22. The flow control valve 24 operates on a command signal from the control unit 30. When the flow control valve 24 opens the first return passage 22, the first pressure regulator 16 is rendered operable to perform the pressure regulation. Closing of the first return passage 22 by the flow control valve 24 renders the first pressure regulator inoperable to stop performing the pressure regulation. A fuel filter 18 is fluidly disposed between the first pressure regulator 16 and the fuel gallery 19 to prevent any contaminents from reaching the fuel injectors 10. The second pressure regulator 20 is disposed in the fuel supply passage downstream of the first pressure regulator 16 with respect to a flow of fuel supply from the fuel pump 14 to the fuel injectors 10. In this embodiment, the second pressure regulator 20 is disposed more adjacent to the fuel injectors 10 than said first pressure regulator 16 is. The second pressure regulator 20 is operable to effect pressure regulation to maintain the pressure differential across the fuel injectors 10 at a second predetermined level P2, for example, about 3.05 kg/cm$^2$, higher than the first predetermined level P1. During this pressure regulation, the fuel is returned to the fuel tank 12 through a second return passage 26. It should be noted that the return flow of fuel through the second return passage 26 contribues more to elevation of the temperature of the fuel within the fuel tank 12 since the fuel return passage 26 conducts fuel having past an area adjacent the cylinder head. It should also be noted that during a mode when the first pressure regulator 16 is rendered operable to effect pressure regulation and the second pressure regulator 20 does not perform the pressure regulation, the fuel returns to the fuel tank 12 through the first return passage 22, while, during another mode when the first pressure regulator 16 is rendered opeable and the second pressure regulator 20 performs the pressure regulation, the fuel returns to the oil tank 12 through the second return passage 26.

Each of the fuel injectors 10 opens to inject fuel into the engine intake manifold toward the intake port of the corresponding engine cylinder when it is energized by the presence of fuel injection pulse. The length of the fuel injection pulse, ie.e., a pulse-width, applied to the fuel injector 10 determined the length of time the fuel injector opens and thus, determined the amount of fuel injected into the engine intake manifold.

The control unit 30 may comprises a digital computer which includes a centeral processing unit (CPU), a random access memory (RAM), a rear only memory (ROM), and an input/output control unit (I/O). The input/output control unit receives a switch ON/OFF signal from the ignition switch 32 and the temperature signal from the fuel temperature sensor 34. The read only memory contains control program for operating the central processing unit.

Figure 2:
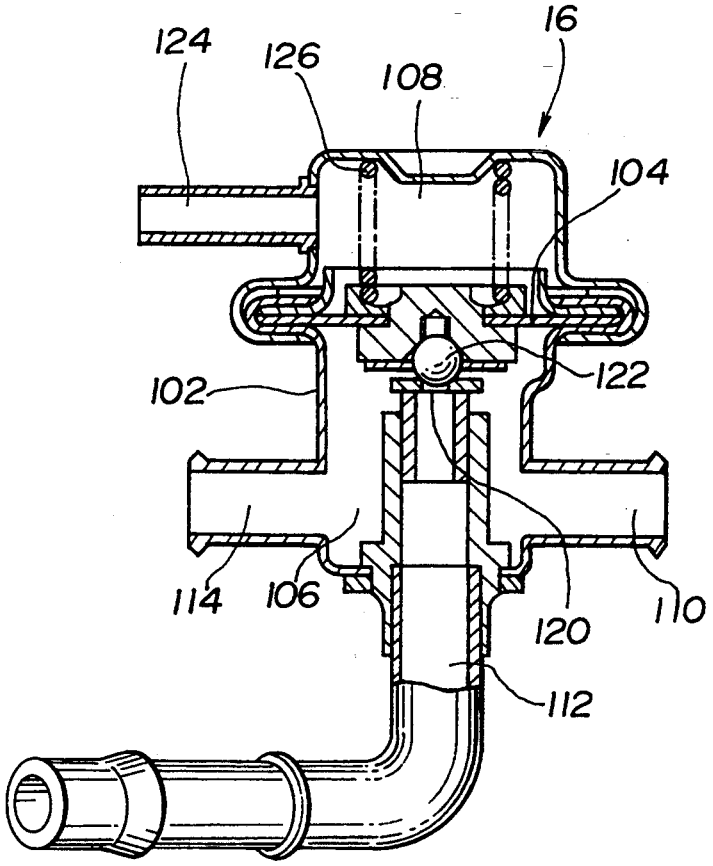
FIG. 2 is a sectional view of the first pressure regulator used in the fuel injection apparatus shown in FIG. 1.

Referring to FIG. 2, the first pressure regulator 16 includes a cylindrical casing 102 containing a diaphragm 104 provided therein to form fuel and pressure chambers 106 and 108 on the opposite sides of the diaphragm 104. The fuel chamber 106 has inlet, outlet and return ports 110, 112 and 114. The inlet port 110 is connected to the fuel pump 14, the outlet port 112 is connected to the fuel filter 18, and the return port 114 is connected to the first return passage 22. The outlet port 112 has a relief aperture 120 at its entry with which a ball-shaped valve body 122 is in cooperation for regulating an entry of fuel into the outlet port 112 from the inlet port 110. The valve body 122 is supported by the diaphragm 104. The pressure chamber 108 is connected through a conduit 124 to the engine induction passage at a position downstream of the throttle valve. A spring 126 is placed in the pressure chamber 108 to bias the diaphragm 104 in the direction closing the relief aperture 120 with the valve body 122. The spring 126 is selected to provide the first predetermined pressure P1 with which the valve body 122 closes the relief aperture 120.

Figure 3:
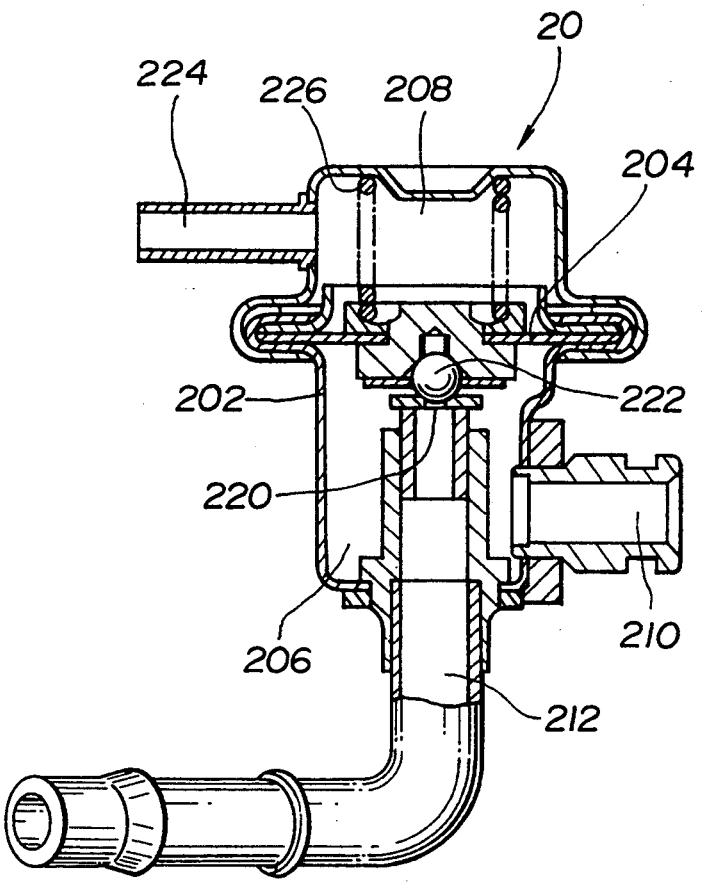
FIG. 3 is a sectional view of the second pressure regulator used in the fuel injection apparatus shown in FIG. 1.

Referring to FIG. 3, the second pressure regulator 20 includes a cylindrical casing 202 containing a diaphragm 204 provided therein to form fuel and pressure chambers 206 and 208 on the opposite sides of the diaphragm 204. The fuel chamber 206 has inlet and outlet ports 210 and 212. The inlet port 210 is connected to the fuel injectors 10, and the outlet port 212 is connected to the second return passage 26. The outlet port 212 has a relief aperture 220 at its entry with which a ball-shaped valve body 222 is in cooperation for regulating an entry of fuel into the outlet port 212 from the inlet port 210. The valve body 222 is supported by the diaphragm 204. The pressure chamber 208 is connected through a conduit 224 to the engine induction passage at a position downstream of the throttle valve. A spring 226 is placed in the pressure chamber 208 to bias the diaphragm 204 in the direction closing the relief aperture 220 with the valve body 222. The spring 226 is selected to provide the second predetermined pressure P2 with which the valve body 222 closes the relief aperture 220.

Figure 4:
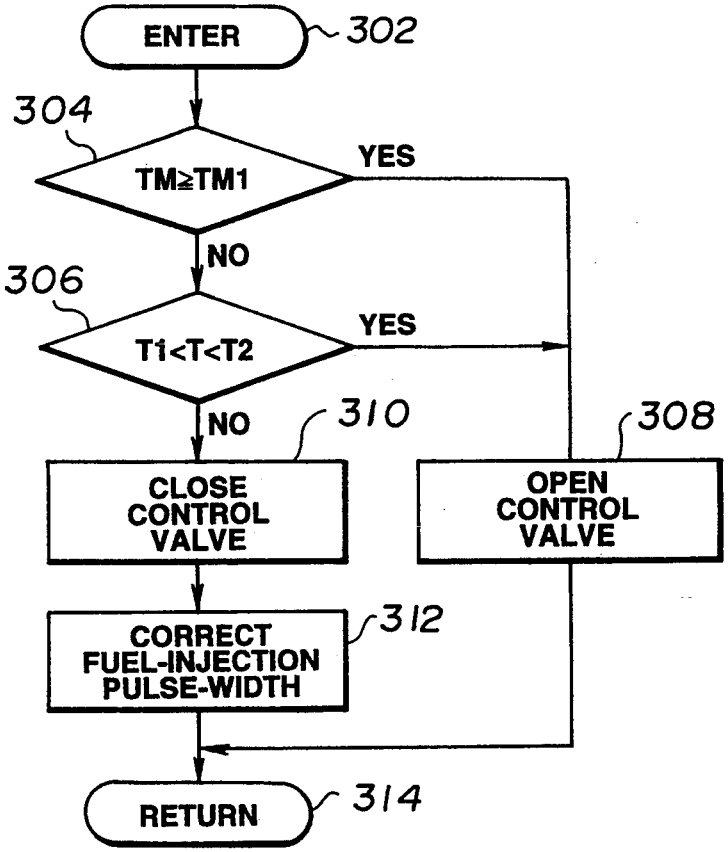
FIG. 4 is a flow diagram.

FIG. 4 is a flow diagram illustrating the programming of the digital computer as it is used to control the control valve 24. The computer program is entered at the point 302. At the point 304 in the program, a determination is made as to whether or not the count TM of a timer is equal to or greater than a predetermined value TM1. This timer starts counting clock pulses when the ignition key switch 32 is turned on. If the answer to this question is "yes", then it means that a predetermined time has elapsed after the engine starts and the program proceeds to the point 308 where a command is produced to open the control valve 24 so as to permit the pressure regulation of the first pressure regulator 16. In this case, the pressure differential across the fuel injectors 10 is regulated at the first predetermined level P1. Otherwise, the program proceeds to another determination step at the point 306. This determination is as to whether or not the fuel temperature T sensed by the fuel temperature sensor 34 is within a predetermined range defined by lower and upper limits T1 and T2. If the answer to this question is "yes", then the program proceeds to the point 308 and then to the point 314 where the computer program is returned to the point 304. Otherwise, it means that the engine starts again at a very high fuel temperature or the engine starts at a very low temperature and the program proceeds to the point 310 where a command is produced to close the control valve 24 so as to inhibit the pressure regulation of the first pressure regulator 16. In this case, the pressure differential across the fuel injectors 10 is regulated at the second predetermined level P2 higher than the first predetermined level P1 by the second pressure regulator 20. Following this, the program proceeds to the point 312 where the fuel-injection pulse-width is corrected to compensate for the fuel pressure increase from the first predetermined level P1 to the second predetermined level P2. Upon completion of this correction, the program proceeds to the point 314 where the computer program is returned to the point 304.

The operation of the fuel injection apparatus of the invention will be described. Under normal engine operating conditions, the control valve 24 opens the first return passage 22 to permit the first pressure regulator 16 to regulate the pressure differential across the fuel injectors 10 at the first predetermined level P1 by varying the amount of excess fuel returned through the first return passage 22 to the fuel tank 12. The second predetermined level P2 set for the second pressure regulator 20 is higher than the first predetermined level P1. As a result, the second pressure regulator 20 closes the second return passage 26 so that the whole amount of fuel supplied from the first pressure regulator 16 can be injected through the fuel injectors 10. Since the first return passage 22 extends away from the engine cylinder head or other heated engine portions, the fuel returned to the fuel tank 12 can remain at a low temperature.

When the engine starts again at a very high fuel temperature or when the engine starts at a very low fuel temperature, the control valve 24 closes the first return passage 22 to inhibit the pressure regulation of the first pressure regulator 16. In this case, the pressure differential across the fuel injectors 10 is regulated at the second predetermined level P2 higher than the first predetermined level P1 by the second pressure regulator 20. This pressure regulation is accomplished by a variation in the amount of excess fuel returned through the second return passage 26 to the fuel tank 12. The fuel heated at a high temperature can be discharged rapidly from the fuel gallery 19 through the second return passage 26 to the fuel tank 12. This is effective to minimized the tendency toward vapor lock near the fuel injectors 10. The tendency toward vapor lock can be further reduced since the pressure P2 of the fuel supplied to the fuel injectors 10 is higher than the normal level P1.

What is claimed is:

1. A fuel injection apparatus for an internal combustion engine, comprising:

a fuel injector connected to a fuel tank through a fuel supply passage for injecting fuel into the engine;

a fuel pump provided in the fuel supply passage for pressurizing the fuel supplied from the fuel tank to the fuel injector;

a first pressure regulator provided in the fuel supply passage, the first pressure regulator being operable for varying the amount of excess fuel returned through a first return passage to the fuel tank to maintain a first predetermined pressure differential across the fuel injector;

a control valve provided in the first return passage for closing the first return passage in response to a command signal;

a second pressure regulator provided in the fuel supply passage downstream of the first pressure regulator, the second pressure regulator being operable for varying the amount of excess fuel returned through a second return passage to the fuel tank to maintain a second predetermined pressure differential across the fuel injector, the second predetermined pressure differential being higher than the first predetermined pressure differential; and a control unit responsive to predetermined engine conditions for producing the command signal to the control valve.

2. The fuel injection apparatus as claimed in claim 1, wherein said first pressure regulator is disposed between the fuel pump and the fuel injector, and said second pressure regulator is disposed more adjacent to the fuel injector than said first pressure regulator is.

3. The fuel injection apparatus as claimed in claim 2, wherein said control unit produces the command signal to the control valve under starting conditions of the engine.

4. The fuel injection apparatus as claimed in claim 3, wherein the control unit includes means for producing a first signal when the engine is starting, means responsive to fuel temperature for producing a second signal when the fuel temperature is out of a predetermined range, and means for producing the command signal in the presence of both of the first and second signals.

5. The fuel injection apparatus as claimed in claim 3, wherein the control unit includes means for measuring a time elapsed after the ignition switch is turned on, and means for producing the first signal when the measured time is less than a predetermined value.

6. In a fuel injection apparatus:

a fuel tank containing fuel therein;

a fuel pump communicating with said fuel tank, said fuel pump being operable to drawn in and discharge the fuel under pressure;

a first pressure regulator having a fuel chamber communicating with said fuel pump to receive the fuel discharged under pressure by said fuel pump, said first pressure regulator having a first relief aperture opening to said fuel chamber and means for regulating discharge of fuel from said fuel chamber to said first relief aperture;

means defining a first fuel return passage having one end formed with said first relief aperture and an opposite end disposed in the fuel contained in said fuel tank to allow return flow to said fuel tank of the fuel discharged out of said first relief aperture;

a control valve disposed in said first fuel return passage, said flow control valve having a closed position closing said first return passage and an open position opening said first return passage;

a plurality of fuel injectors;

a fuel gallery connected to said plurality of fuel injectors, said fuel gallery communicating with said fuel chamber of said first pressure regulator valve;

a second pressure regulator having a second fuel chamber communicating with said fuel gallery, said second pressure regulator having a second relief aperture opening to said fuel chamber and means for regulating discharge of fuel from said second fuel chamber to said second relief aperture; and means defining a second fuel return passage having one end formed with said second relief aperture and an opposite end disposed in the fuel contained in said fuel tank to allow return flow to said fuel tank of the fuel discharged out of said second relief aperture;

means for detecting temperature of fuel in said fuel gallery at a portion adjacent said plurality of fuel injectors and generating a fuel temperature indicative signal;

means for determining whether the detected fuel temperature falls in a predetermined range or not; and means for opening said control valve to render said first pressure regulator operable to effect pressure regulation when it is determined that the detected fuel temperature falls in the predetermined range and closing said control valve to render said first pressure regulator inoperable when said detected fuel temperature falls outside of said predetermined range.

7. A fuel injection apparatus comprising a fuel tank containing fuel, a plurality of fuel injectors for an engine, a fuel gallery fluidly connected to the the plurality of fuel injectors, a fuel pump supplying the fuel to the fuel gallery, and means for regulating return of the fuel from the fuel gallery to the fuel tank, the improvement being such that the regulating means includes a first regulator mounted adjacent the fuel tank and having a first return passage communicating with the fuel tank, a second regulator mounted adjacent the fuel gallery and having a second return passage communicating with the fuel tank, and means for normally rendering said first regulator operable to permit all of the return flow of fuel to pass through said first return passage to the fuel tank, but rendering said first regulator inoperable under a predetermined condition upon starting the engine, causing said second regulator to become operable to permit all of the return flow of fuel to pass through said second return passage to the fuel tank.

8. The improvement as claimed in claim 7, wherein said first return passage is placed at a position away from the engine cylinder to which the plurality of fuel injectors are connected.

9. The improvement as claimed in claim 8, wherein when said second regulator is operable, a pressure differential across the fuel injectors is increased.

* * * * *